United States Patent [19]

Schausberger et al.

[11] 4,166,689

[45] Sep. 4, 1979

[54] APPARATUS FOR WET TREATMENT OF CARRIERS OF PHOTOSENSITIVE MATERIAL

[75] Inventors: Helmut Schausberger, Unterhaching; Konrad Brückl; Günther Sailer, both of Munich, all of Fed. Rep. of Germany

[73] Assignee: AGFA-Gevaert, A.G., Leverkusen, Fed. Rep. of Germany

[21] Appl. No.: 816,942

[22] Filed: Jul. 19, 1977

[30] Foreign Application Priority Data

Jul. 23, 1976 [DE] Fed. Rep. of Germany ..... 2633145

[51] Int. Cl.[2] ..... G03D 3/08

[52] U.S. Cl. ..... 354/321; 354/322; 354/324; 134/64 P; 134/122 P; 118/405

[58] Field of Search ..... 354/312, 313, 314, 319, 354/320, 321, 322, 324, 332, 331; 134/64 P, 122 P; 118/404, 405, 50; 68/181 R, 184, 175, 43, 5 E; 15/100, 256.51

[56] References Cited

U.S. PATENT DOCUMENTS

| | | | |
|---|---|---|---|
| 1,151,281 | 8/1915 | Marcaurele | 15/256.51 |
| 1,901,080 | 3/1933 | Bradner | 118/405 |
| 2,729,192 | 1/1956 | Warner | 118/405 |
| 2,918,069 | 12/1959 | Brown et al. | 354/319 |
| 3,057,282 | 10/1962 | Luboshez | 118/405 |
| 3,255,617 | 6/1966 | Bisang | 118/405 |
| 3,315,501 | 4/1967 | Muller | 68/181 R |
| 3,554,641 | 1/1971 | Jeffee et al. | 118/404 |
| 3,771,428 | 11/1973 | Horner et al. | 354/319 |
| 3,922,702 | 11/1975 | Gaskell | 354/321 |
| 4,064,713 | 12/1977 | Sando et al. | 68/5 E |

*Primary Examiner*—L. T. Hix
*Assistant Examiner*—Alan Mathews
*Attorney, Agent, or Firm*—Peter K. Kontler

[57] ABSTRACT

Apparatus for wet treatment of X-ray films, photographic paper or analogous carriers of photosensitive material has at least one treating unit for carriers, and such treating unit has a liquid-containing vessel with an inlet opening for carriers at the top and an outlet opening for carriers at the bottom, or vice versa. Liquid which escapes from the vessel via opening in the bottom is intercepted by the tank of a sealing device with two squeegees located in the tank above a horizontal passage in line with the openings of the vessel. One or more pairs of advancing rolls in the vessel transport the carriers along a vertical path which extends between the openings of the vessel. The carriers which move downwardly from the upper toward and beyond the lower opening of the vessel thereupon advance along a second vertical path which extends through the nip of the squeegees and through the passage. If the carriers are transported upwardly, they advance from the passage into the nip of the squeegees, into and through the lower opening and emerge from the upper opening of the vessel. The treating unit occupies a minimum of floor space because the carriers therein are caused to advance along vertical paths. A second vertical treating unit can be mounted above or below the one treating unit. Alternatively, the one treating unit discharges carriers into or receives carriers from a conventional treating unit wherein the carriers advance along a substantially horizontal path.

29 Claims, 7 Drawing Figures

2a
10
6
12
12a
2
11
1
5
14
8
14
2d
9
13
20
19
13a
2b
7
20a
15
27
21
15a
18
4a
28
15a
3
6'
4
12'
17
2'
16a
17a
16
22
26
25
24
1'
23

3
13a
13
2
15
34
35
35
30
31
34
33a
32
32
35
33
35
18
29
28
29
15a

APPARATUS FOR WET TREATMENT OF CARRIERS OF PHOTOSENSITIVE MATERIAL

BACKGROUND OF THE INVENTION

The present invention relates to apparatus for wet treatment of X-ray films, photographic paper and/or other web- or sheet-like carriers of photosensitive material. More particularly, the invention relates to improvements in apparatus wherein carriers of photosensitive material are transported through one or more liquid baths, for example, by resorting to one or more pairs of advancing rolls.

Apparatus of the just outlined character are especially suited for wet treatment of sheet- or web-like carriers in a developing machine. As a rule, a developing machine comprises several vessels each of which contains a different liquid (e.g., a developer, a fixing bath and a rinsing bath), and successive carriers are transported seriatim through the various baths prior to entering a drying unit. The intervals of dwell of carriers in various vessels are determined by the speed at which the carriers are transported through the developing machine, by the distances which the carriers cover during travel through the respective baths, and by the dimensions of the vessels.

In presently known apparatus for wet treatment of X-ray films, photographic paper or the like, the carriers of photosensitive material are invariably transported along a substantially horizontal path. In most instances, the apparatus are so-called table models and, since the path along which the carriers move is horizontal, such apparatus occupy a substantial amount of floor space. Moreover, the attendant who is stationed at the inlet where successive carriers enter the first bath is incapable of monitoring the outlet because the latter is located at a substantial distance from the inlet.

OBJECTS AND SUMMARY OF THE INVENTION

An object of the invention is to provide a novel and improved apparatus which can be used for wet treatment of carriers of photosensitive material or the like and occupies only a fraction of floor space which is occupied by conventional apparatus.

Another object of the invention is to provide an apparatus wherein all important parts or stations, especially the inlet and the outlet, are more readily accessible to a single person than in heretofore known apparatus.

A further object of the invention is to provide an apparatus which can be assembled of two or more identical or different units or modules, which can be readily converted for treatment of web- or sheet-like carriers by one or more liquids and vice versa, and wherein successive carriers can be caused to move along the desired path or paths with a surprisingly high degree of predictability and reproducibility.

An additional object of the invention is to provide the apparatus with one or more novel and improved treating units or modules for carriers of photosensitive material, such as X-ray films, webs of photographic paper or the like.

An ancillary object of the invention is to provide the apparatus and its treating unit or units with novel and improved means for preventing uncontrolled escape of liquid from the respective vessel or vessels.

An additional object of the invention is to provide an apparatus which can utilize one or more novel liquid treating units or modules as well as one or more conventional treating units in combination with one or more novel units.

The invention is embodied in an apparatus for wet treatment of sheet- or web-like carriers of photosensitive material. The apparatus includes at least one treating unit which comprises a liquid-containing vessel having an upper part and a lower part (e.g., the top wall and the bottom wall of a container for a developing solution, fixer or rinsing fluid), an inlet opening for admission of carriers in one of the parts, an outlet opening for evacuation of carriers in the other part, one or more pairs of advancing rolls or analogous means for transporting carriers along a substantially vertical path in a direction from the inlet opening toward the outlet opening, and a sealing device disposed below the lower part and having means for intercepting the liquid which issues from the vessel via opening in the lower part. The sealing device further comprises a passage which is provided at its underside and is in line with the openings in the upper and lower parts of the vessel, and means (e.g., a pair of elastically deformable roller-shaped squeegees) defining a second path along which the carriers are free to move in the aforementioned direction between the passage and the opening of the lower part.

If the carriers are fed into the treating unit from below, each carrier moves substantially vertically upwardly, first through the passage, thereupon through the nip of the squeegees, through the opening in the bottom part of the vessel, through the nip or nips of one or more pairs of advancing rolls in the vessel, and issues from the opening in the top part of the vessel. If the carriers are fed from above, they issue from the treating unit by way of the passage at the underside of the sealing device.

The novel features which are considered as characteristic of the invention are set forth in particular in the appended claims. The improved apparatus itself, however, both as to its construction and its mode of operation, together with additonal features and advantages thereof, will be best understood upon perusal of the following detailed description of certain specific embodiments with reference to the accompanying drawing.

DESCRIPTION OF THE PREFERRED EMBODIMENTS

Figure 1:
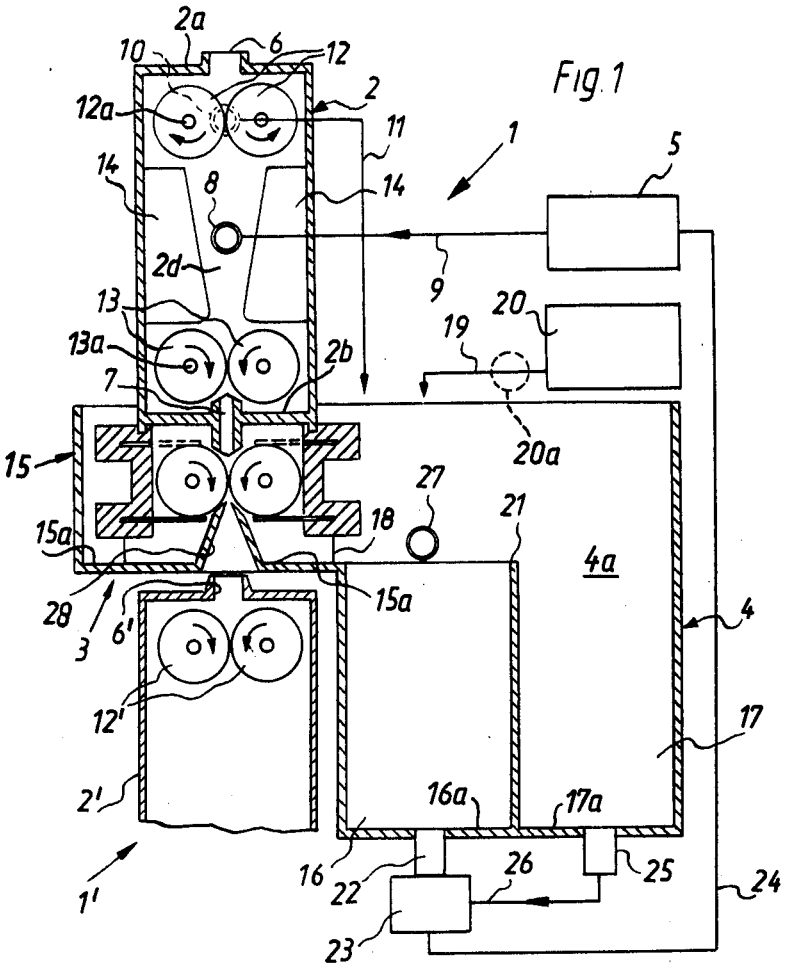
FIG. 1 is a fragmentary schematic partly elevational and partly vertical sectional view of two superimposed treating units which embody one form of the invention.

FIG. 1 shows an apparatus for wet treatment of X-ray films, photographic paper or like carriers of photosensitive material. The apparatus comprises a first or upper treating unit or module 1 having a liquid-containing vessel 2, a sealing device 3 which is disposed below the vessel 2, a tank 4 containing a supply of liquid treating agent and a pump 5 which circulates the liquid along a path extending through the vessel 2 and tank 4. The vessel 2 is a substantially closed container the upper part or wall 2*a* of which has an inlet opening 6 for admission of webs, sheets or analogous carriers of photosensitive material and the lower part or wall 2*b* of which has an outlet opening 7 for evacuation of carriers of photosensitive material. A side wall 2*d* of the vessel 2 has an aperture 8 for admission of liquid via supply conduit 9 which is connected to the pressure outlet of the pump 5, and an overflow aperture 10 which is provided at a level above the aperture 8 and admits surplus liquid into a return conduit 11 serving to convey such liquid into the tank 4.

The means for transporting carriers of photosensitive material through the vessel 2 along a substantially vertical path comprises a pair of upper advancing rolls 12 disposed below the inlet opening 6 and a pair of lower advancing rolls 13 disposed above the outlet opening 7. The vessel 2 further contains suitable means 14 (e.g., inclined walls) for guiding carriers of photosensitive material on their way from the nip of the advancing rolls 12 toward and into the nip of the advancing rolls 13. The walls or guide means 14 flank the aperture 8 and perform or may perform the additional function of causing the inflowing liquid to contact the respective sides of the carriers. The means for driving the advancing rolls 12 and 13 includes the shafts 12*a*, 13*a* and suitable prime mover means (not shown) for transmitting torque to the shafts 12*a*, 13*a*.

A web, sheet or another carrier of photosensitive material which is admitted via inlet opening 6 travels along a substantially vertical path which extends through the nip of the advancing rolls 12, between the guide means 14, through the nip of the advancing rolls 13 and through and beyond the outlet opening 7. It is clear that the direction of movement of carriers can be reversed, i.e., that the carriers can be transported from the opening 7 in the bottom wall 2*b* toward and through the opening 6 in the top wall 2*a* of the vessel 2. The direction of rotation of advancing rolls 12, 13 is then reversed and the guide means 14 are turned through 180 degrees to insure adequate guidance of carriers during travel in the space between the advancing rolls 13 and 12. It is further clear that FIG. 1 shows a rather elementary form of the improved apparatus. For example, the height of the treating unit 1 can be increased practically at will. However, a relatively tall vessel will preferably contain one or more additional pairs of advancing rolls intermediate the rolls 12 and 13 as well as one or more additional guide means, preferably a pair of guide means between each pair of neighboring advancing rolls.

The sealing device 3 includes a receptacle 15 which intercepts liquid issuing from the vessel 2 via outlet opening 7 and has a discharge opening 18 which admits intercepted liquid into a first section 16 of the tank 4. A second section of the tank 4 is shown at 17. All details of means for circulating the liquid through the vessel 2 and tank 4 are not shown in the drawing because such circulating means need not be basically different from or may be analogous with or identical to presently known circulating means, i.e., to circulating means of the type used in apparatus wherein carriers of photosensitive material are caused to travel along a horizontal or substantially horizontal path.

The section 16 of the tank 4 receives liquid which is supplied by the discharge opening 18 of the intercepting receptacle 15 as well as liquid which is supplied by the return conduit 11. Still further, the section 16 receives fresh or regenerated liquid which is stored in a tank 20 and is admitted, either continuously or when necessary, via conduit 19. The tank 20 may contain or may be connected with a suitable pump 20*a* (indicated by broken lines) which supplies to the conduit 19 metered quantities of fresh or regenerated liquid. When the section 16 is filled to capacity, the surplus overflows its edge 21 and enters the section 17 of the tank 4. The overflow edge 21 of the section 16 is located at or close to the level of the bottom wall 15*a* of the intercepting receptacle 15.

A liquid evacuating pipe 22 communicates with an opening in the bottom wall 16*a* of the section 16 and delivers liquid to a jet pump 23 whose outlet is connected with the intake of the pump 5 by a pipe 24. A pipe 25 receives liquid by way of an opening in the bottom wall 17*a* of the section 17 and supplies the liquid to the jet pump 23 via suction pipe 26. The pump 23 mixes the liquids issuing from the sections 16 and 17 prior to admission of the mixture into the intake of the pump 5. The section 17 and/or 16 of the tank 4 further contains means (e.g., coils or other suitable heat exchanger means) for heating and/or cooling the liquid which is evacuated via pipe 25 and/or 22. Thus, the temperature of liquid which reaches the jet pump 23 via pipe 25 and/or 22 is maintained at a preselected value or fluctuates within a rather narrow range.

The volume or capacity of the section 17 preferably exceeds the volume of the vessel 2. This insures that, when the treating unit 1 is idle, liquid flows from the vessel 2 into the intercepting receptacle 15 and thence into the section 16 whereby the surplus (if any) overflows the edge 21 and is stored in the section 17. In other words, the vessel 2 is preferably empty when the unit 1 is idle. It is further preferred to partition the interior of the tank 4 in such a way that the volume of the section 16 exceeds, at least slightly, the volume of the section 17. The wall 4*a* of the tank 4 has an overflow opening 27 which permits the surplus of liquid to leave the tank when the section 17 is filled to capacity. The liquid which leaves the treating unit 1 via overflow opening 27 can be admitted into a main storage tank (not shown), i,e., such liquid is not or need not be immediately recirculated through the apparatus (or is not recirculated at all, e.g., if the liquid is water which is used for rinsing of the carriers).

Figure 2:
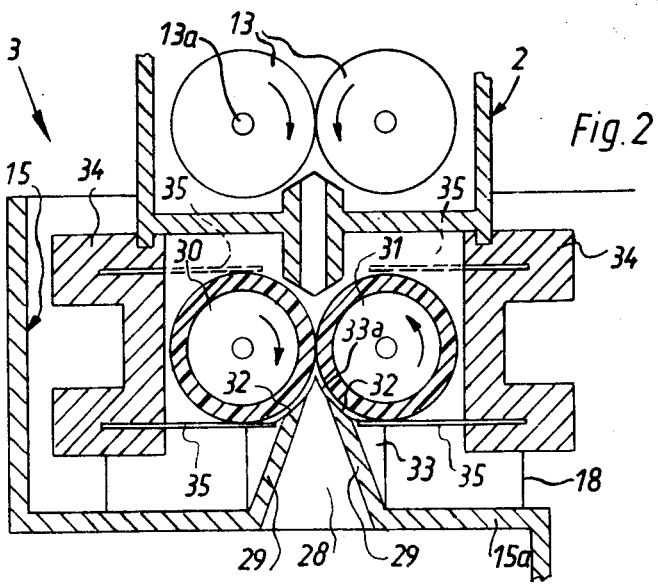
FIG. 2 is an enlarged vertical sectional view of the sealing device in the upper treating unit of FIG. 1.

Additional details of the sealing device 3 are shown in FIG. 2. This device comprises the aforementioned liquid intercepting receptacle 15 with discharge opening 18. The bottom wall 15*a* of the receptacle 15 has a portion which defines an upwardly tapering passage 28 located below two horizontal roller-shaped rotary squeegees 30, 31 serving to remove all or nearly all liquid from the sides of carriers of photosensitive material which issue from the vessel 2 via outlet opening 7. That portion of the bottom wall 15*a* which defines the passage 28 includes two mutually inclined or parallel vertical panels 29 extending transversely along the full width of the receptacle 15 (as considered at right angles to the plane of FIG. 1 or 2).

The axes of the squeegees 30, 31 are parallel to the axes of the advancing rolls 12, 13, and the squeegees are installed in the receptacle 15 immediately below the lower end of the outlet opening 7. At least the outermost portions of the cylindrical walls of squeegees 30, 31 consist of a suitable elastomeric material and the squeegees are sufficiently close to each other to insure that their peripheral surfaces invariable engage the respective sides of a carrier of photosensitive material which issues from the vessel 2 via outlet opening 7. In the absence of a carrier in the sealing device 3, and if one disregards the deformation of cylindrical walls of the squeegees 30 and 31, such cylindrical walls contact each other along a line which is horizontal and parallel to the longitudinal direction of the passage 28.

The upper ends of the panels 29 of the bottom wall **15*a* have inclined flat or concave edge faces 32 which extend into close or immediate proximity of the adjacent portions of peripheral surfaces of the squeegees 30 and 31. At the present time, it is preferred to mount the squeegees 30, 31 in such a way that the distance between their peripheral surfaces and the edge faces 32 is in the range of 0.3 to 1.2 millimeter, most preferably 0.5 to 0.7 millimeter. The edge faces 32 are adjacent to those portions of the peripheral surfaces of squeegees 30, 31 which are located immediately below the nip of 30 and 31**. The length of each edge face equals or approximates the axial length of the squeegees.

The length of the passage 28 equals or slightly exceeds the width of carriers of photographic material which are transported through the vessel 2. The ends of the passage 28 are sealed by sealing elements 33 whose upper edge portions may be provided with ribs extending close to the lowermost points of peripheries of the squeegees 30 and 31. In the embodiment of FIGS. 1 and 2, the radii of curvature of the concave upper surfaces **33*a* of sealing elements 33 preferably equal or approximate the radii of squeegees 30, 31 and the distance between the concave surfaces 33*a* and the peripheral surfaces of the squeegees is preferably within the aforementioned range of 0.3 to 1.2 mm, most preferably 0.5 to 0.7 mm. Each surface 33*a*** preferably extends along an arc of approximately 90 degrees, as considered in the circumferential direction of the respective squeegee.

The receptacle 15 further supports or embodies suitable holders 34 for doctor blades 35 whose exposed portions contact the peripheral surfaces of the squeegees 30, 31. In the embodiment of FIGS. 1 and 2, each of the squeegees 30, 31 is engaged by two elastic blades 35 which are disposed diametrically opposite each other with respect to the axis of the corresponding squeegee. These blades preferably consist of a corrosion-resistant metallic or synthetic plastic material (e.g., stainless steel). Each blade 35 contacts the respective squeegee along the fuel axial length of the squeegee or at the least along the full length of the passage 28.

The operation of the treating unit 1 is as follows:

In the first step, the pump 5 is started to draw liquid from the tank 4 and to admit pressurized liquid into the supply conduit 9 for admission into the vessel 2 via aperture 8. The level of liquid in the vessel 2 rises and the liquid finally begins to overflow via aperture 10 which admits the liquid into the return conduit 11 for introduction into the section 16 of the tank 4. In the next step, a first web, sheet or analogous carrier of photosensitive material is introduced into the vessel 2 via inlet opening 6 whereby such carrier advances in a downward direction to pass through the nip of the advancing rolls 12, between the guide means 14, through the nip of the advancing rolls 13 and into the outlet opening 7. The peripheral speed of the advancing rolls 12 is the same as that of the advancing rolls 13. The leader of the carrier thereupon enters the nip of the squeegees 30, 31 and leaves the receptacle 15 via passage 28 at the underside of the sealing device 3.

If the treating unit 1 is mounted at a level above a second treating unit (a portion of a second module or unit is shown in FIG. 1, as at 1'), the leader of the carrier immediately enters the inlet opening 6' and thereupon the nip of the advancing rolls 12' in the vessel 2' of the second unit 1'.

The sealing device 3 insures that the liquid which flows downwardly through the outlet opening 7 is intercepted and returned into the tank 4. It has been found that the quantity of liquid which leaks from the treating unit 1 is negligible. Furthermore, the sealing device 3 prevents liquid which is circulated in the unit 1 from entering the vessel 2' of the unit 1'. This is often important because each unit normally contains or may contain a different liquid. The sealing action of the device 3 is attributable to elasticity of the squeegees 30, 31 which are deformed against and thus sealingly engage successive increments of the carriers advancing along a second vertical path from the outlet opening 7 toward the passage 28. Some of the liquid which flows from the vessel 2 via outlet opening 7 is intercepted between the upper halves of the sequeegees 30, 31 and flows axially of the squeegees to enter the receptacle 15. Some of the liquid overflows the uppermost portions of the squeegees 30, 31 and flows into the receptacle 15. The sealing elements 33 insure that liquid which reaches or flows toward the axial ends of the squeegees 30, 31 cannot flow into the passage 28. Any liquid which happens to pass through the nip of the squeegees 30, 31 adheres to the peripheral surfaces of the respective squeegees and enters the receptacle 15 by way of the gaps between the peripheral surfaces of the squeegees and edge faces 32 of panels 29. The inclination of edge faces 32 is such that these edges faces promote the flow of droplets into the receptacle 15.

The blades 35 break up the liquid films which accumulate on the peripheries of the squeegees 30 and 31. The films of liquid which are stripped off the squeegees 30, 31 by the blades 35 are caused to flow in parallelism with the axes of the squeegees and overflow the blades 35 to descend into the receptacle 15. If desired, the apparatus may be provided with adjusting means for changing the distance between the blades 35 and the peripheries of the respective squeegees 30, 31 and to thus regulate the amounts of liquid flowing into the section 16 of the tank 4 and the quantity of regenerated liquid which is admitted into the section 16.

Figure 3:
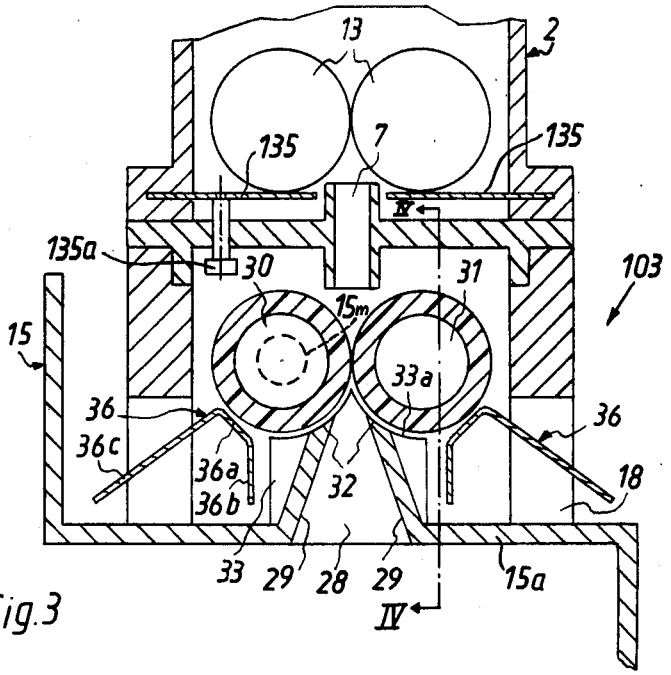
FIG. 3 is a vertical sectional view of a modified sealing device and of a portion of the associated vessel.
Figure 4:
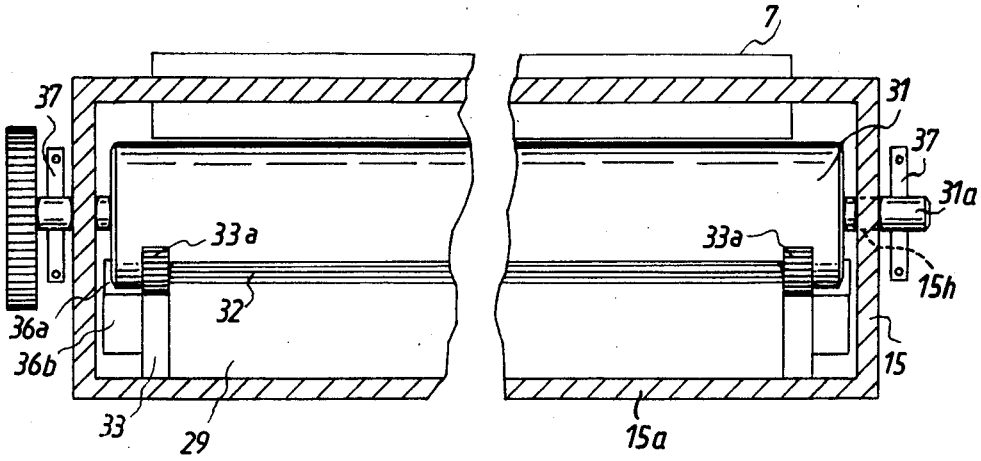
FIG. 4 is a sectional view as seen in the direction of arrows from the line IV—IV of FIG. 3.

FIGS. 3 and 4 show a portion of a modified treating unit, and more particularly a modified sealing device 103. All such parts of FIGS. 3 and 4 which are identical with or clearly analogous to corresponding parts of the unit 1 of FIGS. 1–2 are denoted by similar reference characters. The blades 35 are replaced with flow regulating plates 36 each of which comprises a first portion **36*a* and two additional portions 36*b*, 36*c*. The portions 36*a* serve to interrupt the liquid films at the peripheries of the respective squeegees 30, 31, and the additional portions 36*b*, 36*c* serve to guide the liquid. Each portion 36*a* is a relatively narrow flat or curved piece of sheet metal or the like whose minimum distance from the periphery of the respective squeegee is preferably 0.3 to 1.2 mm, most preferably 0.5 to 0.7 mm. The additional portions 36***b*, and 36*c* flank the respective portion 36*a*, and each of the portions 36*b*, 36*c* extends downwardly close to the upper side of the bottom wall 15*a* of the intercepting receptacle 15. This insures that liquid which flows along the additional portions 36*b*, 36*c* and into the body of liquid in the receptacle 15 creates minimal turbulence. Prevention of turbulence is particularly important when the liquid in the vessel 2 and receptalce 15 is a developing solution whose oxidation is promoted by agitation.

It will be noted that the plates 36 perform the same function as the blades 35 (they interrupt the liquid films on the rotating squeegees 30, 31) and further insure highly satisfactory admission of removed liquid into the receptacle 15.

FIG. 4 shows that the shaft 31*a* of the squeegee 31 is biased sideways by leaf springs 37 which urge the periphery of the squeegee 31 against the periphery of the squeegee 30 (not shown in FIG. 4). The shaft 31*a* is movable in elongated slots 15*h* of the receptacle 15. The shaft of the squeegee 30 is mounted without any freedom of sidewise movement (see the circular opening 15*m* in FIG. 3; this opening receives one end of the shaft of the squeegee 30 and insures that the latter rotates about a fixed horizontal axis which is parallel to the passage 28 and to the axes of advancing rolls in the vessel 2). The part 30*d* denotes an element of the drive means for the squeegee 30.

In the treating unit of FIGS. 3 and 4, the vessel 2 contains elastic blades 135 for the advancing rolls 13. At least one of these blades is adjustable by a screw 135*a* to change the width of the gap between the adjustable blade and the respective advancing roll. This determines the quantity of liquid which flows into the sealing device 103 and the quantity of regenerated liquid which is admitted into the compartment 16 of the tank 4 (not shown in FIGS. 3 and 4). Similar adjusting means can be provided for the blades 35 of the treating units 1 and 1' shown in FIGS. 1 and 2. Furthermore, the sealing device 103 of FIGS. 3 and 4 may comprise means for varying the distance between the concave or flat upper surfaces of portions 36*a* of flow regulating plates 36 and the peripheries of the respective squeegees.

Figure 5:
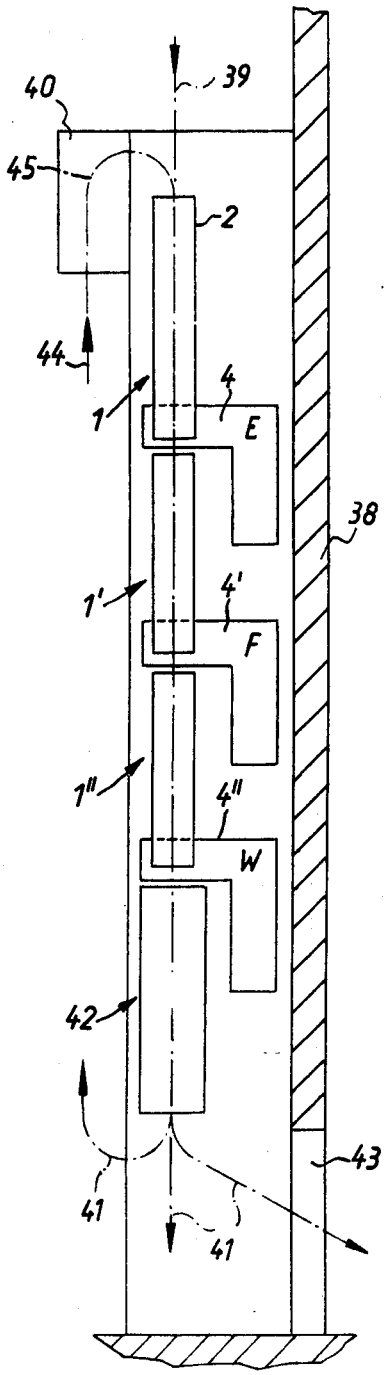
FIG. 5 is a schematic elevational view of an apparatus which is assembled of three improved treating units and further comprises an upright drying unit for carriers issuing from the lowermost treating unit.

FIG. 5 shows an apparatus which comprises three superimposed treating units 1, 1' and 1'' and a drying unit 42 below the lowermost treating unit 1''. The apparatus of FIG. 5 may constitute a developing machine wherein the tank 4 of the uppermost unit 1 contains a supply of developer E, the tank 4' of the unit 1' contains a supply of fixer F, and the tank 4'' of the unit 1'' contains a supply of rinsing or washing liquid W. The drying unit 42 and the treating units 1, 1', 1'' are mounted at one side of an upright supporting member 38 and the depth of the entire apparatus, as considered in a direction from the left to the right, need not exceed 30 centimeters. Thus, the floor space requirements of the improved apparatus are negligible, especially when compared with the floor space requirements of conventional apparatus wherein carriers of photosensitive material are caused to move along horizontal or nearly horizontal paths during travel through the developing, fixing and rinsing baths.

The outlet at the lower end of the upright drying unit 42 can discharge the carriers in any desired direction. The arrows 41 indicate three different directions, namely, upwardly, downwardly and substantially horizontally through an opening or window 43 of the supporting member 38. The means for guiding the carriers as they issue from the outlet at the lower end of the drying unit 42 is not shown in FIG. 5. The vertical path along which the carriers are caused to advance through the units 1, 1', 1'' and the drying unit 42 is indicated by the phantom line 39. The reference character 40 denotes a mechanical deflector which is used to guide carriers 44 along an arcuate path 45 toward and into the inlet opening of the vessel 2 of the uppermost treating unit 1. The units 1, 1' and 1'' may but need not be identical; if they are identical, the major part of the apparatus of FIG. 5 can be assembled of identical prefabricated modules each of which constitutes one of the units 1 to 1''. It is clear that the number of treating units can be reduced to less than three or increased to more than three, depending upon the characteristics of carriers and on the nature of desired treatment.

Substantial savings in floor space can be achieved even if the treating units 1, 1' and 1'' are disposed side-by-side rather than one above the other. This will be readily appreciated since the floor space requirements of the unit 1, 1' or 1'' are only a fraction of floor space requirements of a conventional treating unit wherein the carriers must travel along a horizontal path. If the units 1 to 1'' are disposed side-by-side, the apparatus further comprises suitable mechanical or other types of deflectors to guide the carriers from the outlet opening of the first treating unit into the inlet opening of the second treating unit and from the outlet opening of the second treating unit into the inlet opening of the third treating unit. It is immaterial whether the first treating unit of a group of two or more treating units which are disposed side-by-side receives carriers from above or from below. If the apparatus comprises only two upright treating units which are mounted at the same level, and if it is desired that each treating unit receive carriers from above, the deflector between the two units will cause successive carriers to advance from the lower end of the first treating unit to the upper end of the second treating unit. If the first treating unit is to receive carriers from above and the carriers are to issue from the upper end of the second treating unit, the deflector merely guides successive carriers from the lower end of the first unit to the lower end of the second unit.

Figure 6:
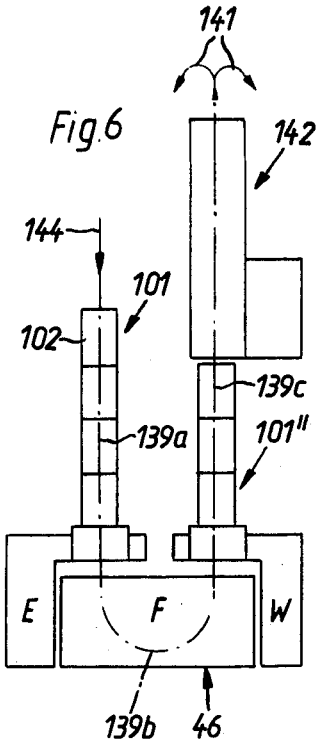
FIG. 6 is a schematic elevational view of an apparatus which includes several improved treating units and a conventional treating unit.

FIG. 6 shows a different apparatus wherein the carriers 144 are transported along a composite path including a vertical portion 139*a*, a substantially horizontal portion 139*b* and a vertical portion 139*c*. The upright treating unit 101 serves to contact the carriers 144 with a liquid developer E; the unit 46 serves to contact the carriers with a fixing liquid F; and the upright treating unit 101'' serves to contact the carriers with a washing or rinsing liquid W. A drying unit 142 above the treating unit 102'' can discharge treated carriers 144 in any desired direction (two such directions are indicated by arrows 141). The unit 46 is a conventional fixing unit wherein rollers or analogous guiding and advancing means cause the carriers 144 to move along the substantially horizontal path portion 139*b* which may but need not be a meandering path.

The apparatus of FIG. 6 occupies more floor space than the apparatus of FIG. 5 but much less floor space than a conventional developing machine wherein the carriers must travel along horizontal paths during transport through each liquid bath. Apparatus of the type shown in FIG. 6 can be used when the height of the space which is available for the various units is less than necessary to allow for the mounting of all units one above the other. It will be noted that the inlet of the vessel 102 in the unit 101 is close to the outlet at the upper end of the drying unit 142 so that an attendant who feeds carriers 144 to the unit 101 can also monitor or collect the carriers issuing from the drying unit.

FIG. 6 further shows that the height of the treating unit 101 exceeds the height of the treating unit 101''. Such height depends on the desired period of dwell of carriers in the respective units. In FIG. 5, the height of the unit 1 exceeds the height of the unit 1' or 1''.

Figure 7:
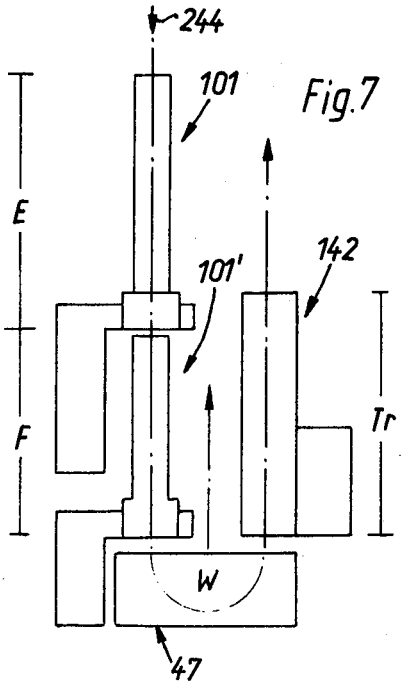
FIG. 7 is a schematic elevational view of an apparatus which constitutes a modification of the apparatus shown in FIG. 6.

The apparatus of FIG. 7 is a modification of the apparatus which is shown in FIG. 6. The upright developing and fixing units 101 and 101' are disposed one above the other, a conventional washing unit 47 is mounted below the sealing device of the unit 101', and the lower end of the upright drying unit 142 receives carriers 244 from the unit 47. The floor space requirements of the apparatus of FIG. 7 equal or approximate those of the apparatus shown in FIG. 6.

FIGS. 5, 6 and 7 merely show three of a large number of possible combinations of the improved treating units with each other or with one or more conventional treating units. For example, the apparatus of FIG. 5 can be mounted upside down so that the carriers 44 would be fed into the passage of the unit 1 and would thereupon advance upwardly along a vertical path extending through the units 1, 1', 1'' and 42 in that order. Treated carriers would issue at the upper end of the drying unit 42. Furthermore, the unit 1 or 101 can be used in combination with the conventional units 46 and 47. All such modifications and many others will be readily understood without additional illustrations. The exact manner in which the units of the apparatus are assembled depends on the dimensions of the space which is available in a photographic processing laboratory or in another institution wherein carriers for photosensitive material or the like must be transported through one or more liquid baths.

In addition to the aforementioned advantages, the improved apparatus exhibits the further advantage that all or nearly all of its parts are more readily accessible than in a conventional developing machine or the like. This reduces the maintenance cost, especially if the units of the apparatus are mounted in such a way (particularly in a manner as shown in FIG. 5) that each and every component which is likely to require frequent inspection or repair is accessible at the front side of the apparatus. Still further, the apparatus renders it possible to feed carriers to the inlet opening of the foremost unit in any desired direction as well as to remove or expel carriers from the outlet opening of the last unit in any desired direction. This renders it possible to install the apparatus in an existing production line for the processing of exposed photographic films, X-ray films or the like.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. Apparatus for wet treatment of sheet- or web-like carriers of photosensitive material, comprising at least one treating unit including a liquid-containing vessel having an upper part and a lower part, one of said parts having an inlet opening for admission of carriers and the other of said parts having an outlet opening for evacuation of carriers; means for transporting carriers along a substantially vertical first path in a direction from said inlet opening toward said outlet opening; and a sealing device connected with said vessel, disposed below said lower part and including means for intercepting the liquid which issues from said vessel through the opening of said lower part, said device having an underside provided with a passage in line with said openings and sealed from the opening of said lower part, and means defining a second path along which carriers are free to move in said direction between said passage and the opening of said lower part, said path defining means comprising a pair of rotary squeegees having cylindrical carrier-engaging walls consisting at least in part of elastomeric material and disposed at the opposite sides of said second path.

2. Apparatus as defined in claim 1, wherein said transporting means comprises at least one pair of rotary advancing members installed in said vessel at the opposite sides of said first path.

3. Apparatus as defined in claim 1, wherein said passage is elongated and is substantially horizontal and, in the absence of a carrier in said second path, said walls contact each other along a line which is substantially parallel to and located above said passage.

4. Apparatus as defined in claim 1, wherein one of said squeegees is rotatable about a fixed axis and further comprising means for biasing the other of said squeegees sideways toward said one squeegee.

5. Apparatus as defined in claim 1, wherein said passage is elongated and substantially horizontal and extends from below close to the nip of said squeegees, said sealing device further comprising a pair of faces adjacent to the peripheries of said squeegees below said nip, said peripheries and the respective faces defining two narrow gaps disposed at the opposite sides of said second path.

6. Apparatus as defined in claim 5, wherein the width of each of said gaps is between 0.3 and 1.2 millimeters.

7. Apparatus as defined in claim 5, wherein the width of each of said gaps is between 0.5 and 0.7 millimeter.

8. Apparatus as defined in claim 5, wherein at least one of said faces is flat.

9. Apparatus as defined in claim 5, wherein at least one of said faces is concave.

10. Apparatus as defined in claim 5, wherein the length of each of said faces approximates the axial length of the respective squeegee.

11. Apparatus as defined in claim 5, wherein said sealing device comprises two spaced apart panels which define said passage, said faces being provided on said panels.

12. Apparatus as defined in claim 11, wherein said panels are substantially vertical and substantially parallel to each other.

13. Apparatus as defined in claim 11, wherein the width of said passage decreases upwardly in a direction toward the nip of said squeegees.

14. Apparatus as defined in claim 1, wherein said passage is elongated and said sealing device further comprises a pair of sealing elements at the ends of said passage, said sealing elements having concave surfaces adjacent to the peripheries of said squeegees and disposed below the nip of said squeegees.

15. Apparatus as defined in claim 14, wherein said concave surfaces extend along arcs of approximately 90 degrees, as considered in the circumferential direction of the respective squeegees.

16. Apparatus as defined in claim 14, wherein said concave surfaces and the peripheries of the respective squeegees define gaps having a width of between 0.3 and 1.2 millimeters.

17. Apparatus as defined in claim 14, wherein said concave surfaces and the peripheries of said squeegees define gaps having a width of 0.5 to 0.7 millimeter.

18. Apparatus as defined in claim 1, wherein said passage is elongated and said sealing device further includes at least one flexible elongated blade for each of said squeegees, said blades bearing against the peripheries of the respective squeegees to break up the films of liquid at the respective peripheries, the length of each of said blades approximating the length of said passage.

19. Apparatus as defined in claim 1, wherein said sealing device further includes two fluid flow regulating members, one for each of said squeegees and each including a portion adjacent to the periphery of the respective squeegee below the nip of said squeegees.

20. Apparatus as defined in claim 19, wherein said portions and the respective squeegees define gaps having a width of 0.3 to 1.2 millimeters.

21. Apparatus as defined in claim 19, wherein said portions and the respective squeegees define gaps having a width of 0.5 to 0.7 millimeter.

22. Apparatus as defined in claim 19, wherein said portions have flat surfaces adjacent to and defining narrow gaps with the respective squeegees.

23. Apparatus as defined in claim 19, wherein said portions have concave surfaces adjacent to and defining narrow gaps with the respective squeegees.

24. Apparatus as defined in claim 19, wherein said fluid flow regulating members extend in parallelism with the axes of said squeegees and each thereof further comprises at least one additional portion adjacent to one side of and extending downwardly from the respective first mentioned portion.

25. Apparatus as defined in claim 1, further comprising a second treating unit disposed below the sealing device of said one unit.

26. Apparatus as defined in claim 1, further comprising a liquid containing tank and means for circulating liquid from said tank into said vessel and from said sealing device into said tank.

27. Apparatus as defined in claim 1, further comprising a second treating unit defining a substantially horizontal path for carriers, said horizontal path merging into one of said first and second paths at a locus remote from the other of said first and second paths.

28. Apparatus as defined in claim 1, further comprising means for adjusting the rate of liquid flow through the opening of said lower part and into said sealing device.

29. Apparatus as defined in claim 28, wherein said transporting means comprises at least one pair of rotary advancing members mounted in said vessel at the opposite sides of said first path, said adjusting means comprising at least one blade adjacent to the periphery of one of said rotary members and means for changing the distance between said periphery and said blade.

* * * * *